US006609420B2

(12) United States Patent
Dooley

(10) Patent No.: US 6,609,420 B2
(45) Date of Patent: Aug. 26, 2003

(54) TRANSLATING SPINNER

(75) Inventor: Robert B. Dooley, Canton, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 192 days.

(21) Appl. No.: 09/839,738

(22) Filed: Apr. 23, 2001

(65) Prior Publication Data

US 2003/0037609 A1 Feb. 27, 2003

(51) Int. Cl.[7] ..... G01L 5/14
(52) U.S. Cl. ..... 73/167; 73/865.6; 73/865.3
(58) Field of Search ..... 73/167, 865.3, 73/865.6

(56) References Cited

U.S. PATENT DOCUMENTS

| | | | | | |
|---|---|---|---|---|---|
| 3,597,969 | A | * | 8/1971 | Curchack | 73/167 |
| 3,718,041 | A | * | 2/1973 | Jones | 73/167 |
| 3,727,455 | A | * | 4/1973 | Boder | 73/167 |
| 4,010,631 | A | * | 3/1977 | Pollin | 73/12.05 |
| 4,022,053 | A | * | 5/1977 | Teng et al. | 73/12.05 |
| 4,038,869 | A | * | 8/1977 | Curchack | 73/167 |
| 4,557,143 | A | * | 12/1985 | Pollin | 73/167 |

OTHER PUBLICATIONS http://www.fbodaily.com/cbd/archive/1999/06(June)/04–Jun–1999/Asol004.htm, "Commerce Business Daily" (Jun. 2, 1999).*

* cited by examiner

*Primary Examiner*—Michael J. Carone
*Assistant Examiner*—Troy Chambers
(74) *Attorney, Agent, or Firm*—Paul S. Clohan, Jr.; William V. Adams

(57) ABSTRACT

The invention features a modified catch tube component capable of performing the function of the conventional catch tube and the conventional MEM simultaneously. The catch tube will also feature a capability to accept modular units of mass for adjusting the available angular momentum (of the spinning catch tube) as well as to incrementally adjust inertial resistance for controlling post-impact translational motion. The safety and performance enhancements of the modified spinner are achieved by the above mentioned integration of the MEM with the catch tube. This invention will eliminate MEM free flight and prevent excessively soft, or excessively hard projectile impacts. Equipment such as rails and wheel sets are used to assure that the motion of the catch tube is constrained to translation and to rotation. The invention contrasts conventional spinners in that the motion of a conventional catch tube is limited to rotation only and the MEM to translation and rotation.

6 Claims, 3 Drawing Sheets

TRANSLATING SPINNER

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

This invention presents modifications and improvements to conventional projectile launch simulation devices. These devices are used to simulate the translational and angular accelerations encountered by projectiles during launch from rifled gun barrels. The simulation process is known as the Reverse Ballistic Launch Simulation Method (RBLSM) and consists essentially of the following two events.

1) the setback event (to simulate translational accelerations by means of rapidly decelerating a backwards oriented projectile), and
2) the spin event (to simulate angular accelerations resulting from projectile engagement with the lands and grooves of a rifled barrel by applying torque to a non-spinning projectile). Assemblies designed to perform these simulations are referred to herein as "spinners".

During simulation operations, a conventional spinner is designed to expel a component referred to as a momentum exchange mass (MEM) from the spinning impact containment chamber, referred to as the catch tube. The projectile's transferred linear momentum results in the deceleration of the projectile (to zero translational velocity in a successful operation) and the MEM being expelled from the rear opening of the catch tube (with a fraction of the projectiles impacting velocity). The modified spinner design contrasts the conventional design by introducing a translational degree of freedom for the catch tube. Modifications to the catch tube configuration results in a single entrance for the projectile, mitigator, and MEM as opposed to the open rear design of conventional catch tubes. The modification to the catch tube as well as the additional degree of freedom eliminates passage of any or all components through the catch tube as a consequence of the impact event.

2. Discussion of Related Art

A conventional spinner system is depicted in FIG. 1. Currently, spinners used to perform the RBLSM consist of, but are not limited to, the following components: catch tube 1, mitigator 2, momentum exchange mass 3, stationary catch tube support bearings 4, and drive train/brake system 5. In typical operations, the catch tube 1 is loaded with the mitigator 2 and the momentum exchange mass 3 as shown in FIG. 1. The drive train 5 is powered up resulting in the transmission of torque to the catch tube 1. The applied torque results in spinning the catch tube 1 about the bore axis 6 at a pre-selected rate of revolutions per unit time. The projectile 7 enters the forward end of the catch tube 1 and impacts the mitigator 2. The mitigator 2 begins to deform thereby decelerating the projectile 7 as well as dissipating some quantity of the projectile's 7 translational kinetic energy. The mitigator 2, while spinning at the same rate of revolutions per unit time as the catch tube 1, begins to transfer torque to the projectile 7. This applied torque results in increasing the angular velocity of the projectile 7 up to a desired rate thereby eventually achieving a post impact equilibrium angular velocity with the catch tube 1. Both mitigator 2 deformation and torque transmission to the projectile 7 requires the support of an inertial mass as provided by the momentum exchange mass 3. Without the momentum exchange mass 3, the mitigator would be pushed through the catch tube 1 without appropriately decelerating or spinning up to the required rotation rate.

The purpose of the catch tube 1 is to remain stationary (with regards to translation along the projectile's 7 flight path) and to act as a guide, or path constraining device for the projectile 7, mitigator 2 and MEM 3 throughout the impact and deceleration (acceleration) events. Typically, in conventional spinners, the MEM 3 exits the catch tube 1 while the mitigator and projectiles remain in the catch tube (as their translational velocities have become zero due to the momentum transfer and kinetic energy exchange occurring during impact).

To simulate the setback event, in which translational accelerations are applied to the projectile 7, the momentum exchange mass 3 functions as an inertial mass against which the mitigator 2 is supported (from rearward translational motion) by means of the MEM's 3 inertial resistance. The inertial resistance to motion supplied by the momentum exchange mass 3 results in the deformation of the mitigator 2 and the deceleration of the projectile 7 at or near empirically determined rates. The linear momentum of the projectile 7 however, is conserved and is transferred through the mitigator 2 to the momentum exchange mass 3. As a consequence of the transferred momentum, the MEM 3 takes on a translational velocity collinear with that of the projectile 7 and exits the rear of the catch tube 1. A successful setback event for a non-spinning projectile is one in which the translational deceleration of the test projectile 7 is equal to, (in terms of magnitude and duration) but of opposite sign, as the translational acceleration(s) of an actual gun launched projectile.

To simulate the spin event, the MEM 3 provides the necessary inertial resistance to translational motion of the mitigator 2 thereby assuring axial deformation of the mitigator 2 (i.e. kinetic energy absorption and linear momentum exchange) during the impact event. The projectile 7, in contact with the mitigator 2 during the impact event, begins to rotate due to the interface friction between the mitigator 2 and projectile 7. The spin rate of the projectile is a function of the interface friction forces. The instantaneous angular velocity of the projectile 7 changes from what was initially zero revolutions per unit time (as test projectiles are generally launched from smooth bore gas-guns) to the final catch tube 1 rotation rate.

A successful application of the RBLSM involves precise control of both the transferred angular momentum and the linear deceleration rate. Ideally, the simultaneous occurrence of the setback and spin events closely simulate the effective accelerations encountered in actual gun launch. Total acceleration of the projectile is the instantaneous vectorial sum of both translational deceleration and angular acceleration. The control and adjustment of these rates are achieved by choosing the appropriate mass for the MEM 3, selecting the appropriate mitigator 2 material, and by custom profiling conical tips (impact/friction surface) on the mitigator 2.

SUMMARY OF THE INVENTION

The invention features a modified catch tube component capable of performing the function of the conventional catch tube and the conventional MEM simultaneously. The catch tube will also feature a capability to accept modular units of mass for adjusting the available angular momentum (of the spinning catch tube) as well as to incrementally adjust inertial resistance for controlling post-impact translational motion. The safety and performance enhancements of the modified spinner are achieved by the above mentioned integration of the MEM with the catch tube. This invention will eliminate MEM free flight and prevent excessively soft, or excessively hard projectile impacts. Equipment such as rails and wheel sets are used to assure that the motion of the catch tube is constrained to translation (a degree of freedom collinear with the catch tube bore axis) and to rotation (a degree of freedom about the catch tube bore axis). The invention differs from conventional spinners in that the motion of a conventional catch tube is limited to rotation only and the MEM to translation and rotation (along and about the bore axis respectively).

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

Figure 1:
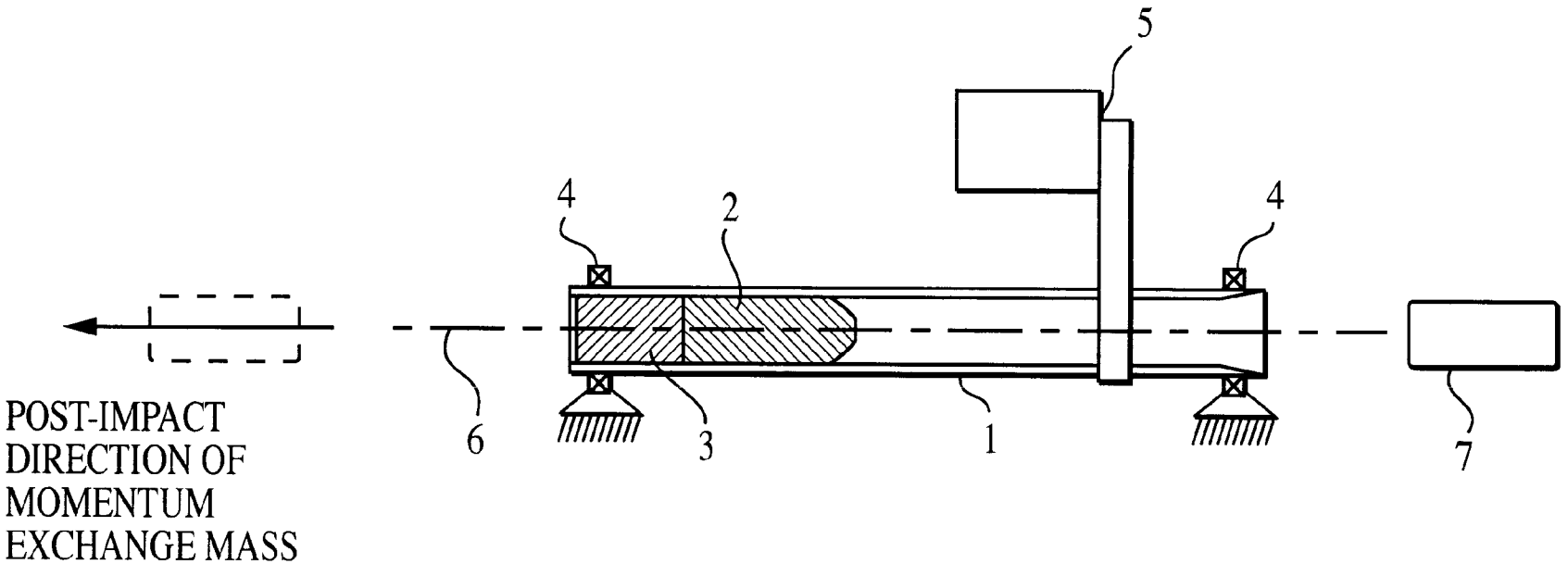
FIG. 1 PRIOR ART
FIG. 1 depicts a conventional spinner prior to projectile 7 impact. The momentum exchange mass 3 would be ejected from the catch tube 1 after the projectile's 7 linear momentum is transferred through the mitigator 2.
Figure 2:
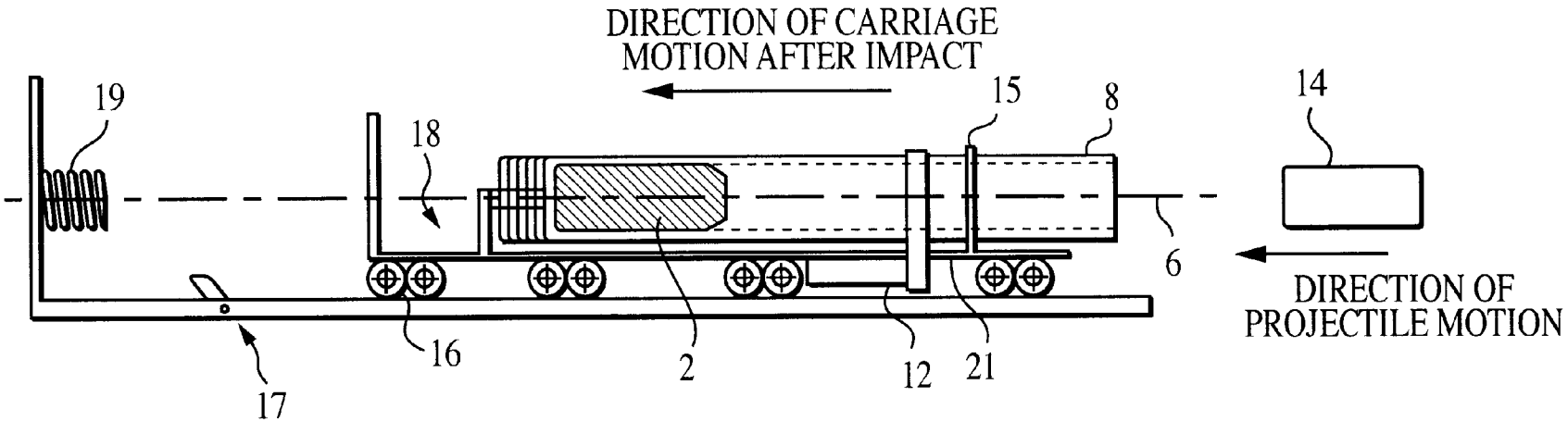
FIG. 2 shows the invention prior to projectile 14 impact. Rather than ejecting a momentum exchange mass 3 as would be the case with a conventional spinner, this system would have a translating carriage 21 that is constrained by rails or guidance equipment.
Figure 3:
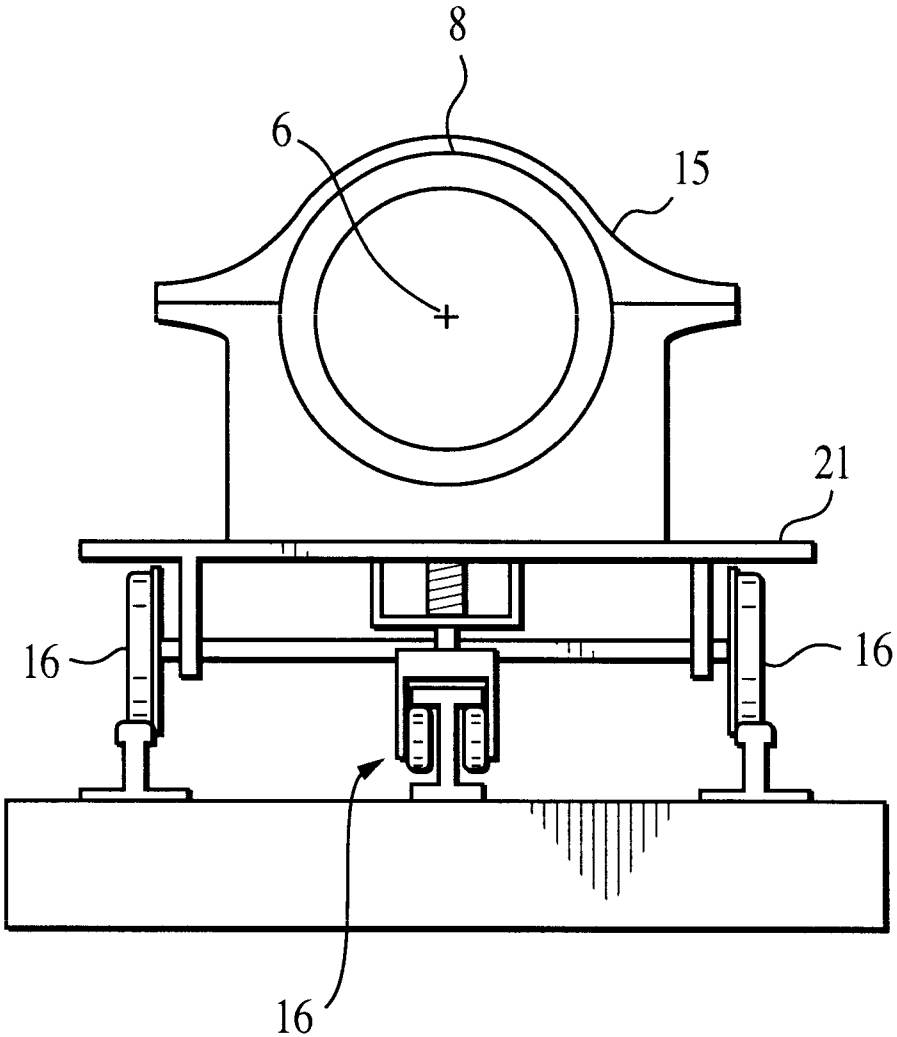
FIG. 3 shows the front view of the invention.

Referring now to FIG. 2, the modified catch tube spinner invention provides a translational degree of freedom for the catch tube 8. This additional degree of freedom is achieved by mounting the catch tube 8, catch tube bearings 15 and the drive train\brake system 12 on a translating carriage 21 as shown in FIGS. 2 and 3. The carriage 21 is constrained from lateral motion by a guide such as a set of rails and wheel sets 16. This arrangement provides a known mass (the sum of all translating parts) to assume the inertial resistance function of the momentum exchange mass 3 in the conventional design (as shown in FIG. 1). The invention (FIGS. 2 and 3) eliminates the significant and variable influence of friction between the momentum exchange mass (3 in FIG. 1) and the catch tube (1 in FIG. 1) bore walls in the inertial resistance function. Friction between these components, which can vary from operation to operation, contributes a significant resistance force to post impact momentum exchange mass (3 in FIG. 1) motion.

Consequently, translational loading rates (setback) applied to the projectile will be more consistent between test shots. Additionally, the exact position of the momentum exchange mass 3 in the catch tube 1 during the deceleration of the projectile 7 is no longer relevant in determining the loading rate of the projectile 7. Determination and analysis of these rates are achieved (with the invention shown in FIGS. 2 and 3) by observation of projectile 14 motion and carriage 21 motion simultaneously.

Commercially available velocity monitoring instrumentation can be applied to report and record carriage 21 velocity as a function of position. This information, coupled with projectile 14 velocity data, can be used to determine projectile 14 loading/acceleration rates.

Results obtained from preliminary test shots may indicate that either of the two loading rates (translational or rotational) may require adjustments. To increase the translational load rate, additional units of mass can be added to the carriage 21 in the mass bay 18. Conversely, the translational loading rate may be reduced by removing weight from the carriage 21. Spin rate control may be modified in a similar manner. Catch tube 8 rotation rate data may indicate a significant reduction in revolutions per unit time during the impact event. In such a case, mass units can be added to the modified catch tube 8 to increase the available angular momentum. Additional mass units would reduce the sensitivity of the catch tube to angular velocity reduction during the impact event. Consequently, the spin-up rate of the projectile 14 would be increased. Conversely, lowering the spin-up rate of the projectile 14 could be accomplished by removing modular units of mass from the spinning catch tube 8.

In general, the invention allows the operator(s) to adjust both loading rates without permanently modifying system components. Conventional spinners do not offer this flexibility and require fabrication of appropriately weighted major components based on the test shot parameters. The invention also provides/suggests methods of control as the resistance to translation can be varied by means other than inertia alone (such as braking with springs, dashpots, weights and pulleys etc. connected between the carriage 21 and any fixed (non-translating) point).

The modified catch tube spinner invention is also safer to operate than conventional spinners. The modified catch tube spinner system has no post impact free flying components. Conventional spinners typically eject a momentum exchange mass 3 from the rear of the catch tube 1 after projectile impact. This component must be properly arrested from unconstrained motion and allowed to dissipate translational and rotational kinetic energy to bring the MEM 3 to rest. Failure to properly constrain the momentum exchange mass 3 may result in damage to instrumentation, system components, facilities, and the momentum exchange mass 3 itself. Additionally, the task of loading the momentum exchange mass 3 into the catch tube 1 before a test shot is not required with the modified catch tube spinner invention. The MEM 3 loading task is difficult and dangerous due to the massive weight and size of the MEM 3. Frequently, cranes, mechanical devices and tools are required to position the MEM 3 in the catch tube 1. No such operations are required with the invention.

Simplified arresting gear for the carriage 21 consists of a ratchet 17 to prevent bounce back of the carriage after impacting the buffer spring 19. The buffer spring 19 absorbs the translational kinetic energy of the carriage 21 and can be released at a controlled rate. This can be accomplished, for example by attachment of a threaded rod between the carriage 21 and buffer spring mount. A nut can be positioned along the rod to further compress the buffer spring such that the ratchet can be released. After releasing the ratchet, the nut can be moved along the threaded rod to uncompress the buffer spring 19 thereby slowly releasing any stored energy in the arresting gear assembly. A similar operation could be conducted with any assortment of peripheral devices such as a cable and a "come along" or a winch type device designed to release lengths of cable at controlled rates.

Conventional spinner operations require that a momentum exchange mass 3 be loaded into the catch tube 1 for appropriate setback and spin-up events to occur. The momentum exchange mass 3 has a tendency to move about ("walk") in the axial (along the bore axis) direction and to "climb" along the bore wall (as the normal bore wall surface of the catch tube 1 rotates) of the catch tube 1 while rotating. These conditions contribute to a lack of (known) performance variables that can have a significant effect on results obtained from performing the RBLSM with conventional spinners.

The invention enhances the efficiency of the spinner operation by introducing a degree of freedom for the catch tube 1 and by the utilization of spinner mass (and any convenient mass to travel in the translation direction with the system after impact) to replace the momentum exchange mass 3. The result of this configuration will improve results, reduce complexity of operation and enhance safety.

One method of control offered by the invention (as detailed above) would be that the spinning catch tube 8 be mounted on a carriage 21 constrained by rails. Upon impact of the projectile 14, the linear momentum will be transferred to the catch tube 8 which will cause the carriage 21 to roll backwards towards the buffer spring 19. A ratchet 17 positioned beneath the carriage will permit travel of the carriage 21 in the rearward direction but will prevent bounce back after the buffer spring 19 has been compressed and the ratchet has captured the underside of the carriage 21. The initial kinetic energy of the projectile is thereby absorbed in deforming the mitigator 2, moving the carriage 21 and in compressing the buffer spring 19. Other methods to control the direction and rate of carriage motion could be implemented such as a plurality of non-parallel guide rails impinging on a control surface or an active braking system.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

I claim:

1. A device to produce a reverse ballistic launch simulation to a moving projectile comprising:

a cylindrical tube having an open forward end to receive said moving projectile and a closed aft end;

a mitigator to provide linear deceleration to said moving projectile at the aft end of said tube;

means for supporting said tube while allowing translational and rotational movement of said tube;

means for providing said rotational movement to said tube and thereby providing angular acceleration to said moving projectile when said moving projectile enters said tube; and means for arresting the resulting translational movement of said tube caused by said moving projectile entering said tube.

2. The device of claim 1 further comprising a means for adding additional mass to said device.

3. The device of claim 2 wherein said means for supporting said tube comprises a wheeled carriage assembly.

4. The device of claim 3 wherein said means for arresting translational movement of said tube comprises a ratchet and buffer spring assembly.

5. The device of claim 4 further comprising a dashpot to aid in the arresting of translational movement.

6. The device of claim 4 further comprising a shock absorber to aid in the arresting of translational movement.

* * * * *